US008814274B2

(12) United States Patent
MacNeil et al.

(10) Patent No.: US 8,814,274 B2
(45) Date of Patent: Aug. 26, 2014

(54) MACHINE AND METHOD FOR DECONSTRUCTING A VERTICAL WALL

(76) Inventors: Gerard J. MacNeil, Surrey (CA); Gordon W. MacNeil, Delta (CA); David B. MacNeil, Langley (CA); Veron Bose, Langley (CA)

( * ) Notice: Subject to any disclaimer, the term of this patent is extended or adjusted under 35 U.S.C. 154(b) by 196 days.

(21) Appl. No.: 12/705,273

(22) Filed: Feb. 12, 2010

(65) Prior Publication Data

US 2010/0140444 A1 Jun. 10, 2010

Related U.S. Application Data

(63) Continuation-in-part of application No. 10/973,281, filed on Oct. 27, 2004, now Pat. No. 8,191,972.

(51) Int. Cl.
*E04G 23/08* (2006.01)

(52) U.S. Cl.
CPC ..... *E04G 23/08* (2013.01)
USPC ..... 299/17

(58) Field of Classification Search
CPC ..... E04G 23/08
USPC ..... 299/17
See application file for complete search history.

(56) References Cited

U.S. PATENT DOCUMENTS

| | | | | |
|---|---|---|---|---|
| 3,809,318 | A | 5/1974 | Yamamoto | |
| 3,857,516 | A | 12/1974 | Taylor | |
| 4,045,086 | A | 8/1977 | Parkes | |
| 4,074,858 | A | 2/1978 | Burns | |
| 4,081,200 | A | 3/1978 | Cheung | |
| 4,111,490 | A | 9/1978 | Liesveld | |
| 4,795,217 | A | 1/1989 | Hilaris | |
| 4,813,313 | A * | 3/1989 | Ichikawa et al. | 82/128 |
| 4,854,770 | A | 8/1989 | Puchala | |
| 5,010,694 | A * | 4/1991 | Agbede | 451/38 |
| 5,022,927 | A * | 6/1991 | Seidel | 134/34 |
| 5,255,959 | A | 10/1993 | Loegel | |
| 5,765,924 | A | 6/1998 | Liesveld | |
| 6,049,580 | A * | 4/2000 | Bodin et al. | 376/316 |
| 6,179,519 | B1 | 1/2001 | Hilmersson | |
| 6,877,930 | B2 | 4/2005 | Stromdahl | |
| 7,080,888 | B2 * | 7/2006 | Hach | 299/17 |
| 2001/0000003 | A1 | 3/2001 | Cope | |
| 2005/0077775 | A1 | 4/2005 | Nakakuro | |
| 2006/0087168 | A1 | 4/2006 | MacNeil | |
| 2008/0041015 | A1 | 2/2008 | MacNeil | |
| 2008/0317192 | A1 * | 12/2008 | Rowell et al. | 376/249 |

FOREIGN PATENT DOCUMENTS

| | | |
|---|---|---|
| WO | WO 2006/045198 | 5/2006 |

* cited by examiner

*Primary Examiner* — John Kreck

(57) ABSTRACT

A machine and method are disclosed for deconstructing walls and other substantially vertical surfaces. The machine comprises a static, stand-alone support-frame. A carriage is movably mounted on the support-frame, which carriage can be raised and lowered along the support-frame. The carriage includes a carrier-bar, which may be straight or curved. One or more nozzles are mounted to the carrier-bar by means of a nozzle carrier that moves back and forth along the length of the carrier-bar. The nozzles are connected to a high-pressure supply of an erosive material, preferably water. The erosive material, when forced through the nozzles, form jet streams that are directed against the surface of the workface, thereby eroding the surface. Optionally, the invention comprises means of yawing and rotating the nozzles, and means of adjusting the nozzles towards or away from the workface. Optionally, the invention comprises a work platform mounted on the support-frame.

3 Claims, 7 Drawing Sheets

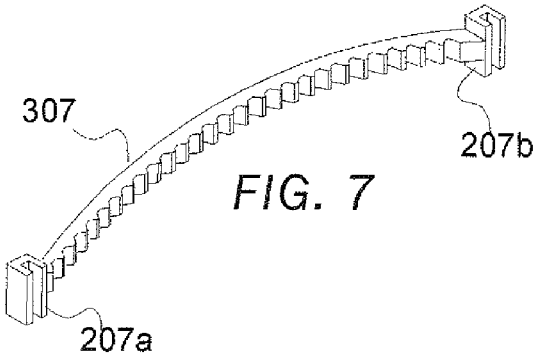
FIG. 7
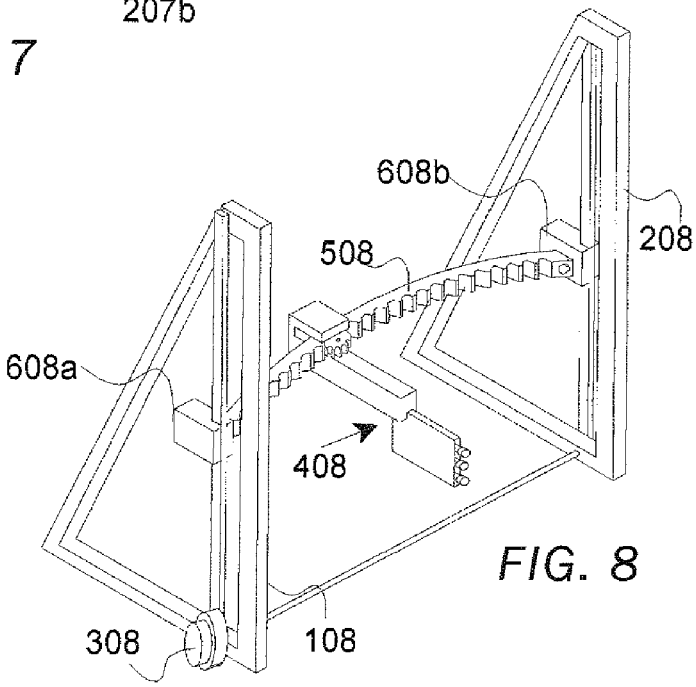
FIG. 8
FIG. 9
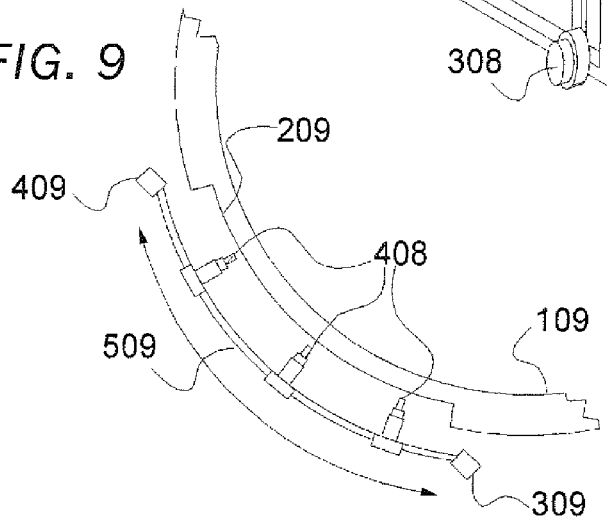

MACHINE AND METHOD FOR DECONSTRUCTING A VERTICAL WALL

RELATED APPLICATIONS

The present application is a continuation-in-part of U.S. application Ser. No. 10/973,281 filed on Oct. 27, 2004, now U.S. Pat. No. 8,191,972 incorporated herein by reference.

FIELD OF THE INVENTION

The present invention relates to machines and methods for removing constituent materials and supporting elements from substantially vertical surfaces.

BACKGROUND

Scope and Use of Certain Terms

The following lexicon sets forth the intended scope and meaning of certain terms and concepts used herein. Examples provided are intended to clarify and not to limit the meaning of the respective term. The definitions set forth here include the singular, plural, and grammatical variations and congeners of the terms defined.

"Wall" and "substantially vertical surface" are used herein interchangeably to mean any surface amenable to being deconstructed by the present invention, and, more specifically, walls and surfaces having an upright orientation within 45 degrees of plumb.

"Deconstruction" refers to the process of dismantling a wall or portion of a wall by removing its constituent material and supporting elements. "Constituent material" refers to the ground substance constituting the wall, such as concrete, brick, mortar, and the like. "Supporting elements" refers to rebar or other supporting materials that contribute to the structure of the wall.

"Workface" refers to a portion of a wall that is to be deconstructed by the present invention.

"Erosive material" is a generic term referring to any suitable material, whether a solid, liquid, or gas, that can be forced through a nozzle at high pressure to produce a sufficiently forceful jet stream required to erode the constituent substance of the wall. Although the preferred erosive material with respect to the present invention is water, the scope of the disclosure and claims includes any material that can be used to deconstruct a wall using the machine and method disclosed and claimed. "Jet stream" refers to a jet stream of an erosive material.

"Static support-frame" refers to a support-frame that has the characteristics of being stationary, free-standing, and immovable during the deconstruction process. More specifically, after it has been set into position adjacent a workface, the static support-frame is not lifted up and down along the workface by a crane, cherry-picker, or other lift means, nor is the static support-frame mounted on a vehicle or otherwise mobile for moving along the wall during the deconstruction process.

"Work platform" refers to a substantially horizontal, flat surface upon which one or more workers stand to gain access to a workface.

"Along the length" refers to a type or direction of movement of one element with respect to a reference, such as an element or a workface. The phrase does not imply, and is not meant to imply, that a first element traverses the entire length of the reference. Movement "along the workface" refers to movement of an element that is, in relevant part, along or substantially within the boundaries of the workface. The terms "along the length" and "along the workface" do not imply, and are not meant to imply, that the moved element necessarily rides upon or is in contact the reference element or workface.

Nature of the Problem

This invention addresses how to deconstruct walls, or portions of walls, particularly curved walls or walls having curved portions. For example, when it becomes necessary or desirable to remove a large piece of equipment from the inside of a concrete structure, often the only way to gain access to the equipment is to breach a hole in a concrete wall and remove the equipment through the hole. A deconstruction process referred to as "hydrodemolition" is often employed in such situations, and a number of hydrodemolition machines and techniques have been developed for these purposes. Hydrodemolition is practiced by forcing an erosive material, generally a liquid such as water, through nozzles at sufficiently high pressure to produce a jet stream that disintegrates the constituent building material, which is normally concrete.

One major problem, particularly with respect to vertical hydrodemolition, addressed by the present invention is getting the nozzles in position adjacent to the workface and sufficiently close to the workface to effectuate the removal of the material constituting the wall. In many situations the workface is a considerable distance off the ground and so various vehicle mounted lifts, "cherry-pickers," and other such crane-type devices have been employed to try and meet this challenge. A major disadvantage of this approach is that the great volume of concrete that is removed from the workface falls down upon the vehicle or on the lift-mechanism, partially burying it and possibly damaging it. What is needed is a means of raising and lowering hydrodemolition nozzles along a workface coupled with a means for moving the nozzles back and forth across the workface without resorting to vehicular devices or crane-type lift devices.

Another aspect of the problem solved by the invention relates to the thickness of the wall being deconstructed. Nuclear reactors, for instance, typically have concrete of the order of 4 feet thick. In order to breach such a wall with hydrodemolition techniques, a system must be in place that allows the hydrodemolition nozzles to travel all the way into the opening that is being cut. Consequently, it is desirable to keep the nozzle carrier, which is considerably wider than the nozzle, from contacting the edge of the opening as the nozzles penetrate the opening because such contact prevents lateral movement of the nozzles and thus prevents access of the jet stream all the way to the lateral edges of the opening, thus shorter and shorter lateral passes result for each of a set of passes. The untoward result is side edges of the opening stepped towards the center as the opening grows deeper, thereby narrowing the opening unacceptably. What is needed is a means of directing the jet streams beyond the edge of the nozzle carrier.

Yet another aspect of the problem solved by the invention is that both personnel and equipment must get access to the workface periodically. For instance, hydrodemolition techniques cannot be used to remove metal rebar that is normally embedded in concrete walls. Consequently, as the hydrodemolition process moves deeper into the workface, it is necessary to periodically suspend hydrodemolition activity in order to cut exposed rebar out of the way so deeper layers of concrete can be accessed and removed. Even when automated hydrodemolition techniques are used to remove the concrete, removal of the rebar must be done manually with torches or other metal cutting equipment. Other tasks ancillary to removing the concrete, such as inspecting the workface and monitoring progress, must also be done right at the workface. Currently, this means that the hydrodemolition apparatus must be removed from the vicinity of the work-surface so that the rebar cutters and other ancillary workers can gain access to the workface.

This aspect of the problem is exacerbated by the fact that the workface is often a considerable distance off of the ground. For instance, when a generator is being removed from a concrete nuclear reactor housing, the workface where the housing wall is being breached may be thirty-feet or more above the ground. It is therefore necessary for the workers removing the rebar or performing other ancillary tasks to be lifted up to the workface once the hydrodemolition machinery has been removed from the vicinity of the workface. This presently necessitates the use of a "cherry-picker" or other type of lift for lifting the ancillary workers, which, in turn, necessitates not just additional expense of engaging a lift, but also lost time in getting the hydrodemolition machinery out of the way, getting the lift in position to lift the workers, moving the lift out of the way again once the ancillary workers have completed their tasks, and re-positioning the hydrodemolition machinery.

It would be a very significant advance in the field of vertical hydrodemolition, and it is an objective of this invention, to provide a hydrodemolition machine having a static support-frame that is set into position adjacent a workface and is operable to lift both hydrodemolition equipment and personnel to work on an elevated workface without having to engage separate lifts and without having to reposition the support-frame once it is in position.

A further problem addressed by the present invention is nuclear reactors, cooling towers, and such normally have an elliptical or round profile in horizontal cross-section. If such curved surfaces are attacked with hydrodemolition nozzles moving back and forth along a straight, horizontal carrier-bar, it is necessary to constantly adjust the distance of the nozzles from the workface in order to maintain a constant cutting depth over the width of the workface. Furthermore, additional, constant rotational adjustments are required in order to keep the jet oriented at 90-degree angle to the surface, which is important, particularly at the lateral ends of the opening.

BRIEF SUMMARY OF THE INVENTION

The present invention provides a hydrodemolition machine for removing the constituent material from a workface. The hydrodemolition machine has a stand-alone static support-frame placed at the workface. The support-frame is static in the sense that once it is put into place, it is not necessary to move it in order to carry out the hydrodemolition process. Optionally, the static support-frame may be placed on and attached to an anchor platform.

A carriage is movably attached to the support-frame so that the carriage is operable to be raised and lowered on the support frame along the workface. A lift-mechanism is provided to raise and lower the carriage.

The carriage includes a carrier-bar. The term "carrier-bar" is used herein to mean a bar, rail, or other support structure along which a nozzle or nozzle carrier moves. Depending upon the application, the carrier-bar may be straight or curved for the reasons set forth below.

At least one nozzle is mounted on the carrier-bar, preferably by way of a nozzle carrier. A carrier drive-mechanism is provided to move the nozzle back and forth along the carrier-bar.

The term "lift-mechanism" is used herein to mean that collection of sub-components that functions to raise and lower the carriage up and down the support-frame. The term "drive-mechanism", without a modifier, should be understood to mean that collection of sub-components that functions to move nozzles back and forth along the carrier-bar.

Each nozzle is supplied with high-pressure erosive material that forms a jet stream emitted by the nozzle. The preferred erosive material is water. Also optionally included are nozzle adjusters such as a means for yawing nozzles about a vertical axis, means for rotating the nozzles about a longitudinal axis so that nozzle jets can be directed beyond the sides of the nozzle carrier, and means for extending and retracting the nozzles toward and away from the wall.

The hydrodemolition machine optionally incorporates a work platform for lifting and lowering workers along the workface. The work platform has a safety railing and is mounted directly or indirectly to the support-frame such that the work platform can be raised and lowered along the workface by means of a raising and lowering mechanism. In a preferred embodiment the work platform is attached to the carrier-bar and a single lift-mechanism is used to raise and lower both the carriage and the work platform. The lift-mechanisms and the drive-mechanism can be implemented by known technology including motor driven lead screw mechanisms, chain and sprocket mechanisms, belt and pulley mechanisms, and rack and pinion mechanisms.

BRIEF DESCRIPTION OF THE DRAWINGS

In the drawings identical reference numbers are employed to identify identical elements. The sizes and relative positions of the elements in the drawings are not necessarily to scale. For example, thickness is generally not drawn to scale and is enlarged to promote comprehension.

FIG. 7 is a perspective drawing of a curved carrier-bar.

FIG. 8 is a perspective drawing of the invention with the curved carrier-bar installed on a hydrodemolition machine according to one embodiment of the of the invention.

FIG. 9 is a top elevation of a portion of curved wall being deconstructed with a hydrodemolition machine according to one embodiment of the of the invention.

DETAILED DESCRIPTION OF THE INVENTION

The inventive concepts and novel features of the invention are described here with reference to specific preferred embodiments of the invention. These embodiments represent the best mode currently known to us for practicing the invention. Although the steps and elements of the invention, as well as their structural and functional relationships, may be easily comprehended with respect to the preferred embodiments disclosed herein, it is to be noted that these disclosures are representative of many possible embodiments that fall within the scope of the claims and that incorporate the inventive concepts of our invention. The division of the elements into components and sub-components is arbitrary and is provided to make the description clearer. In many cases a given element may be classified as being a part of more than one component.

Structural Elements

Figure 1:
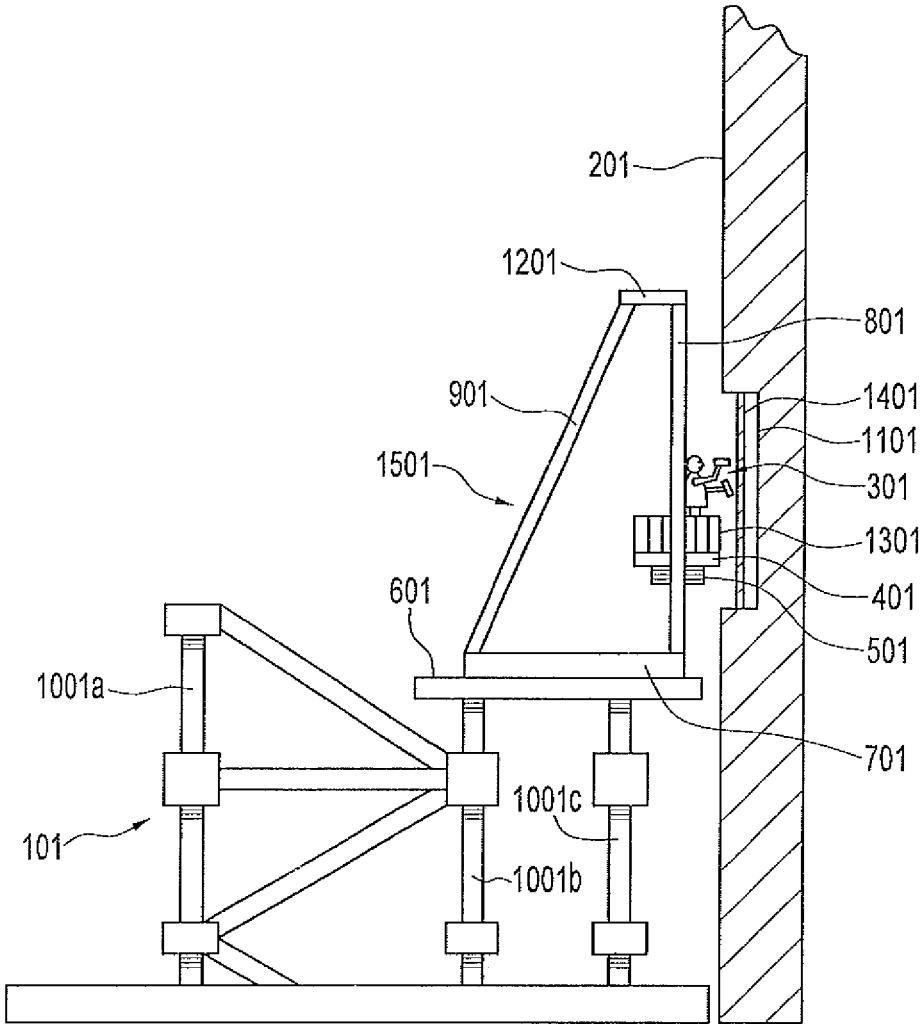
FIG. 1 is a side elevation of a hydrodemolition machine according to one embodiment of the invention placed in position adjacent a wall shown in vertical cross-section.

FIG. 1 shows a side elevation of a hydrodemolition machine according to one embodiment of the of the invention in place adjacent a concrete wall 201, which is shown in vertical cross-section. The wall is being breached by cutting an opening through the wall with hydrodemolition techniques. The workface 1101 is shown in progress with the opening about half-way through the wall. Exposed rebar that has not yet been removed is indicated as 1401.

The hydrodemolition machine includes a free-standing, static, support-frame 1501. Visible in FIG. 1 is the end of the support-frame, which may include vertical member 801, top member 1201, inclined member 901, and bottom member 701. Depending on the size of the support-frame, top member 1201 can be optionally dispensed with so that angled member 901 connects directly to vertical member 801. The opposite end of the support-frame is similarly constructed. For lager frames, one or more horizontal members (not shown in FIG. 1) may connect the two ends.

A carriage 501, fully described below, includes a carrier-bar that spans the width of the support-frame 1501. The carriage is operatively connected to the vertical members of the support-frame so that the carriage can be raised or lowered by a lift-mechanism, as discussed below. The carriage may be as simple as carrier-bar movably supported at its ends by the support-frame for vertical movement and adapted to carry a nozzle carrier back and forth along its length.

Figure 2:
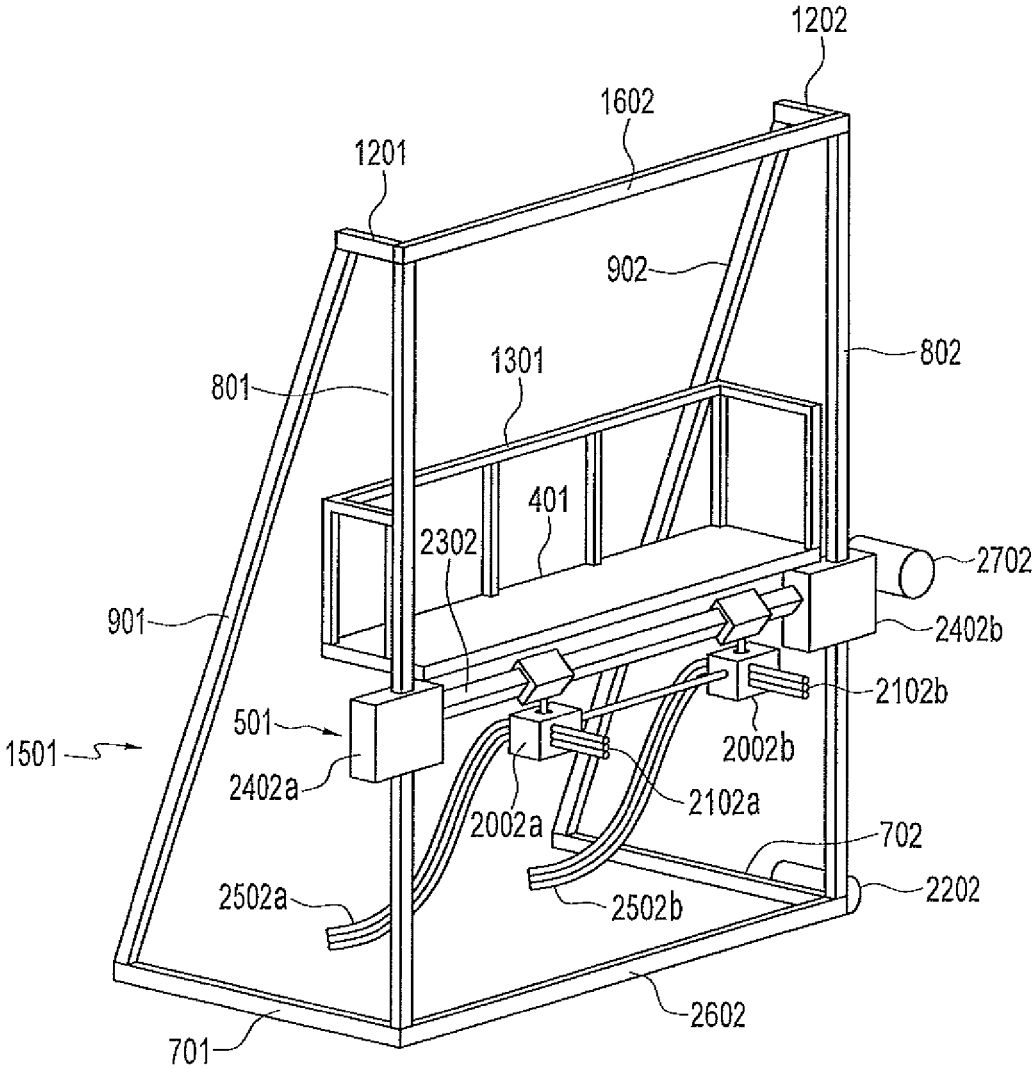
FIG. 2 is a perspective view a hydrodemolition machine according to one embodiment of the of the invention.

Optionally, a work platform 401 is mounted on support-frame, for instance by being mounted on the carrier-bar or other part of the carriage, thereby providing a flat elevator work-surface upon which one or more ancillary workers 301 stand to gain access the workface. When the work platform is mounted on the carriage, the work platform can be raised and lowered on the support-frame 1501 along the workface with the carriage. In one embodiment, the elongate work platform is attached to the carriage by bolting the ends of the work platform to end blocks 2402*a*, 2402*b* (FIG. 2). The precise means of connecting the work platform to the carriage or support-frame is not critical, and a number of means can be easily envisioned. The primary advantage of mounting the work platform on the carriage is that only a single lift-mechanism is required to raise and lower both the work platform and the carriage. However, the work platform and carriage can be attached to the support-frame independently, including means for raising and lowering each element independently of the other. A safety railing 1301 for the work platform is provided.

FIG. 2 shows the various components and sub-components of the hydrodemolition machine of the invention. A first major component of the machine is support frame 1501. The end-members of support frame 1501 are constructed of vertical members 801 and 802, base members 701 and 702, and inclined members 901 and 902. Depending on the size of the area to be deconstructed, in many cases it is sufficient to anchor the end-members with guy wires and concrete blocks, weights or footers. In other cases, horizontal members 1602 and 2602 connect the end-members to provide greater rigidity.

A second major component of the machine is carriage 501, which connects the vertical members of the support frame and provides structural support. The carriage comprises a carrier-bar 2302, which is movably connected to the vertical members 801, 802 by a carriage connector mechanism, such as end blocks 2402*a* and 2402*b*. The end blocks are moveably connected to support-frame vertical members 801, 802 by means of tracks or gear-racks (not visible) on the vertical members. The carriage connector mechanism permits the end blocks, and therefore the entire carriage, to travel up and down the length of the vertical members. The carriage also includes two actuators: a lift-mechanism for raising and lowering the carriage on the vertical members and a drive-mechanism for moving nozzle assemblies to-and-fro along the carrier-bar. The carriage may optionally include the platform 401 with its safety railing 1301 and platform connection mechanism for connecting the platform to the carrier-bar and/or end-blocks.

From this disclosure it will be evident to those skilled in the field, that a variety of devices can be potentially employed as lift-mechanisms to raise and lower the carrier-bar and the work platform. FIG. 2 shows one preferred embodiment in which an actuator, electric motor 2202, turns a sprocket that engages a chain located in vertical member 802. The embodiment shown FIG. 2 employs just one such chain/sprocket lift-mechanism, but a second lift-mechanism can be employed at the opposite end of the support-frame according to the requirements of the job. Depending on the direction of rotation of the output shaft of motor 2202, carriage 501 is raised or lowered along the length of the vertical members 801 and 802.

A third component of the invention is one or more nozzle assemblies 2002*a*, 2002*b* movably attached to the carrier-bar. FIG. 2 shows two such nozzle assemblies, but the scope of the invention contemplates both fewer and more than two, depending on the width and geometry of the workface. The function of the nozzle assembly is to provide a means for connecting one or more nozzles 2102*a*, 2102*b* to the carrier-bar in a manner that permits movement and alignment of the nozzles as described below. The nozzle assembly includes a nozzle carrier, which comprises a nozzle connector mechanism that connects the nozzle carrier to the carrier-bar and a nozzle block, which holds the nozzles.

The nozzle assembly includes various actuator mechanisms for yawing the nozzles, rotating the nozzles about a longitudinal axis, extending and retracting the nozzles. High pressure hoses are used to connect the nozzles to a source of high-pressure erosive material.

Figure 3:
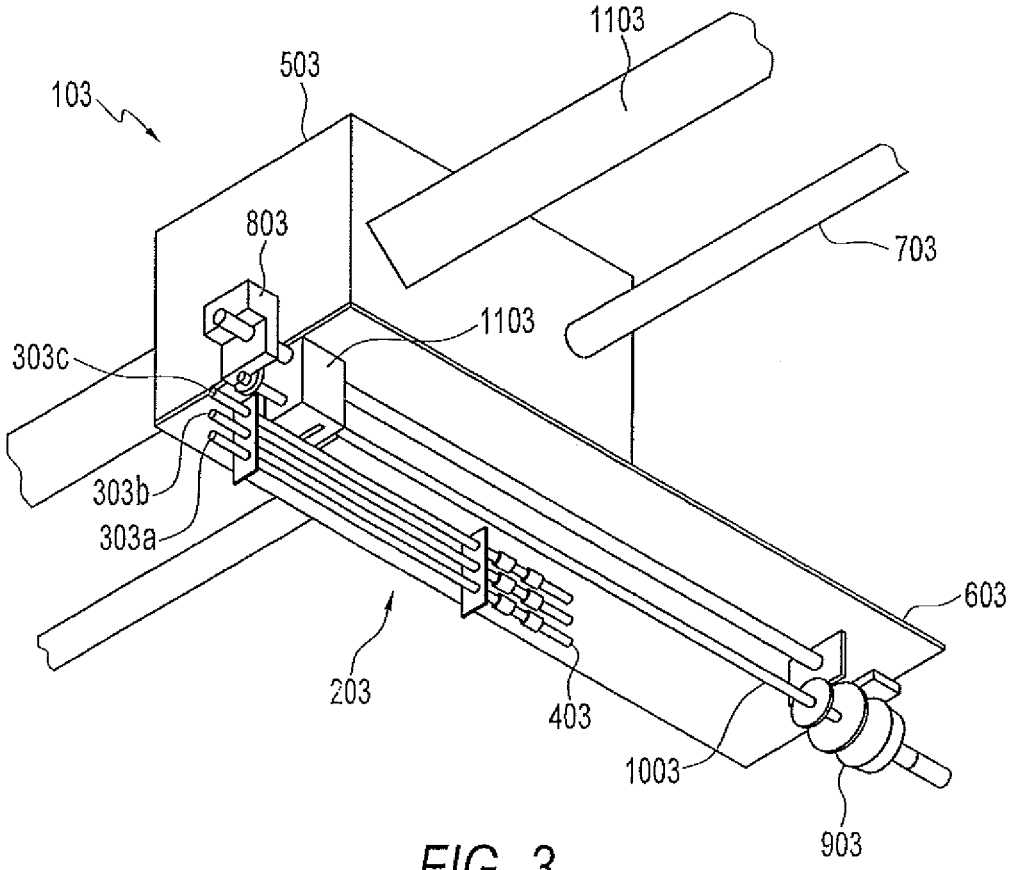
FIG. 3 is a perspective view of a nozzle carrier and a plurality of nozzles.

FIG. 3 shows one preferred embodiment of a nozzle assembly 103. The term "nozzle assembly" is used herein to mean nozzles and those components that are required to mount the nozzles on the carrier-bar and move them back and forth along the carrier bar.

Nozzle carrier 203 is moveably mounted on carrier-bar 1103 by means of nozzle block 503, through which the carrier-bar passes. The nozzle assembly includes plate 603, upon which the nozzles 303*a-c* are mounted. The nozzle carrier is driven back and forth along the length of the carrier-bar by means of a drive-mechanism, which comprises threaded carrier lead screw 703 that engages a threaded bore in nozzle block 503. The lead screw is turned by an actuator, such as the electric motor 2702 shown in FIG. 2. Those of skill in the art will recognize from this disclosure that many types of drive-mechanisms are possible. For instance, lead screws, belt/pulley, rack and pinion, worm gears, chain/sprocket, and the like.

The nozzle assembly shown in FIG. 3 has three nozzles 303*a*, 303*b*, 303*c*, although an assembly could have fewer or more nozzles depending on the requirements of the particular application. Bracket 803 is provided for connecting the nozzle assembly to the nozzle block 503. At the proximal end of each nozzle is a pressure fitting 403 that mates with a pressure fitting on a high-pressure hose (not shown) supplying erosive material under high pressure to the nozzle. When supplied with the high-pressure erosive material, the nozzle emits a jet stream of the erosive material and directs the jet stream against the workface. The preferred erosive material is water, but from the present disclosure those skilled in the invention can, without undue experimentation, adapt the preferred embodiment so as to employ any suitable erosive material. When multiple nozzles are carried by a single nozzle assembly, the hoses 2502*a*, 2502*b* supplying the nozzles may be conveniently tied together to form a plexus, as shown in FIG. 2.

Functional and Operational Features

Figure 4:
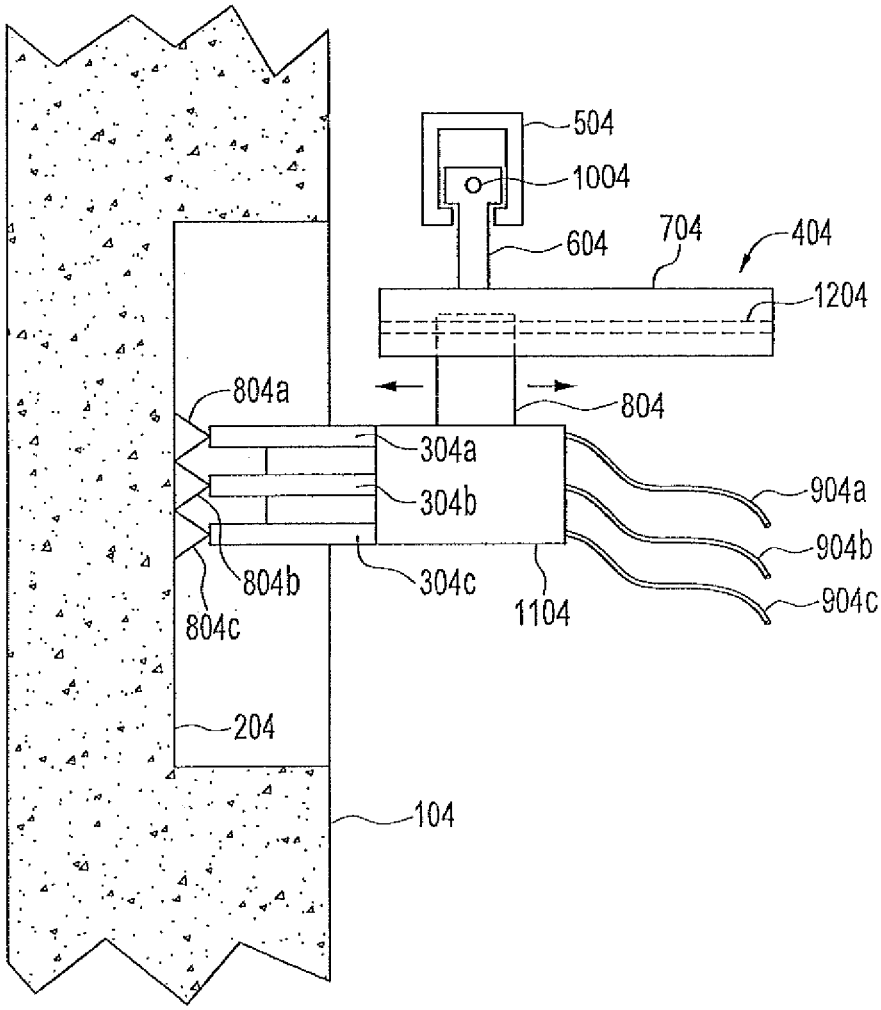
FIG. 4 is a side elevation of nozzle carrier including structure for adjusting a nozzle assembly along its longitudinal axis.

Referring to FIGS. 1, 2 and 4, the manner of using the invention can be easily comprehended.

Prior to moving the invention into position, a workface is mapped on the outer surface of the wall to be breached, The support-frame 1501 is lifted into position adjacent wall 201 by a crane, which positions the support-frame either directly on the ground or, more preferably, on an anchor platform 101 with the vertical members 801 facing the wall and the inclined members 901 facing away from the wall, thereby orienting the support-frame to access the workface.

Once the support-frame 1501 has been put in position it is generally neither necessary nor advisable to move it until the job is completed. The support-frame 1501 is massive enough that it remains fixed and stable even in winds of high enough velocity to prevent "cherry-picker" type devices from being safely used. If an anchor platform is being used, the support-frame 1501 can be bolted to the anchor platform. The anchor platform varies in size and configuration according to the support-frame 1501 and the requirements of a particular job. The anchor platform generally includes a plurality of support columns 1001*a-c* and a horizontal surface 601 upon which the support-frame is mounted.

One or more nozzle assemblies 2002*a* are mounted on the carriage 501 such as shown in FIG. 4. The work platform 401, if required, is mounted to the carriage 501. These assembly steps may be done either prior to or after lifting the support-frame onto the anchor platform, depending on the application and lifting equipment available. A high-pressure water supply is connected to the nozzles 2102 by means of high-pressure hoses 2502.

Using the lift-mechanism 2202, the carriage is lifted to a convenient starting point on the workface. Then the nozzles are extended sufficiently towards the wall and aligned so that they are at an optimum distance and angle for attacking the concrete. Valves controlling the high-pressure water are opened to permit the high-pressure water to pass through the hoses and supply the nozzles. The nozzles thereby produce jet streams directed at the workface. The nozzles move to and fro along the carrier-bar between the vertical members of the support-frame and, hence, back and forth across the workface from one side to the opposing side, thereby eroding the concrete in a linear swath. When the nozzle carrier reaches a pre-set point, it contacts a limit-switch, which causes the drive-mechanism to reverse direction and the nozzle carrier moves back across the workface to the other side where the nearest nozzles to that side are yawed toward that side. Alternatively, the outer nozzles are provided with tips that produce an angular jet stream and the nozzles are rotated thereby allowing the jet stream to erode the side walls of the opening.

These lateral passes are repeated for a desired number of iterations, thereby producing a lateral swath of eroded surface across the workface. Then the carrier-bar is lifted or lowered up or down the support-frame incrementally by the lift-mechanism to a new level on the workface where the process is repeated, thereby producing lateral swath of eroded surface adjacent to the first and increasing the total width of the lateral swath of the eroded surface. The debris produced by the process falls down the face of the wall and accumulates for the most part under the anchor platform where it does not interfere with the equipment or the on-going hydrodemolition process.

As the workface 204 progresses into the wall from right to left in FIG. 4, it is necessary to extend the nozzles further and further into the opening by adjusting the nozzles forward along their longitudinal axes. This is accomplished by a drive-mechanism housed within extension arm 704. In the present embodiment connector piece 804 rides to and fro along the extension arm in a manner analogous to the way rider piece 604 rides along the carrier-bar 504, described above. Threaded lead screw 1204 housed within extension arm 704 engages a threaded orifice in connector piece 604. Lead screw 1204 is rotated by an actuator (not shown) thereby moving the nozzle block and nozzles toward or away from the workface. Rack/pinion, chain/sprocket, and belt/pulley drives are examples of alternative drive-mechanisms that can be used to extend/retract the nozzles toward and away from the workface.

Because carrier-bar 504 is attached to the static support-frame, which is immobile once it is in position, the distance between the carrier-bar and the outer surface of the wall does not change during the operation. Consequently, the lengths of the nozzles and the length of the extension arm must be chosen such that when the nozzles are fully retracted (i.e., to the right in FIG. 4) the nozzle tips are free of the wall surface. Likewise, the length of the nozzles combined with the distance of travel of the nozzle block 1104 along the extension arm 704 must be sufficient to allow the nozzles to be extended far enough into the opening to achieve the intended results.

If the wall is of the type having embedded rebar support, this process is reiterated until a sufficient thickness of the wall has been removed to expose the rebar. When enough rebar has been exposed to prevent further hydrodemolition, the carrier is lowered and one or more workers with rebar cutting equipment mount the work platform 401. The workers are then lifted to the workface where they cut away the exposed rebar with the rebar cutting equipment. When they have finished clearing rebar, the workers are lowered back to the ground or anchor platform, they dismount the work platform, and the carriage is raised again so that concrete can be removed down to the next course of rebar. Thus, it is not necessary to re-position the hydrodemolition equipment, or even remove the nozzle carriers from the carrier-bar, during the rebar cutting process.

The foregoing steps are repeated until the wall is breached or the desired thickness of concrete has been removed.

Variations and Refinements

Extendible Nozzle

It is desirable in view of the objectives of the invention that the nozzles be adjustable longitudinally along their long or longitudinal axes so that the nozzles can be extended toward and retracted away from the workface. This permits the nozzles to be positioned an optimal distance from the workface to deliver a jet stream against the workface with sufficient force to remove the constituent material even while the workface is receding from the outer surface of the wall.

FIG. 3 shows one preferred embodiment for providing this longitudinal adjustability. A hydraulic actuator 903 is coupled to threaded lead screw 1003, which is rotatably received by threads in drive block 1103. The nozzle assembly 203 is connected to and carried by drive block 503; hence, the nozzles are adjustable along their longitudinal axis by controlling actuator 903.

FIG. 4 shows an alternative preferred embodiment for effectuating large longitudinal movements of nozzles required when breaching thick walls. Wall 104 is shown partially breached. The workface 204 is shown cut about halfway through the wall. Nozzle assembly 404 comprises a nozzle block 1104 that holds a nozzle assembly of three nozzles 304 *a-c* that are directing jet streams 804 *a-c* against the workface. A supply of high-pressure water is connected to the nozzles by means of high-pressure hoses 904 *a-c*. The nozzle block is suspended from extension arm 704 by means of connector 804. The extension arm is movably connected to carrier-bar 504 by means of rider 604. The carrier-bar is this embodiment is a hollow steel beam, shown in cross-section in FIG. 4.

The nozzle assembly 404 moves back and forth across the workface (which is to say, in and out of the plane of the figure page) by means of rider 604 being driven back and forth along the length of the carrier-bar 504 by a drive-mechanism. The drive-mechanism shown is threaded lead screw 1004 which engages a threaded orifice of rider 604 and moves the rider when the lead screw is rotated by an actuator, as described above.

Yawing Nozzle

The foregoing disclosures describe embodiments in which the angle of the jet stream with respect to the carrier-bar remains fixed at 90 degrees. This means that the jet streams do not laterally extend beyond the edge of the nozzle carrier. If a deep opening is cut in or through the wall, such fixed-angle embodiments have a number of disadvantages. For instance, when working along the sides of a deep opening, as the nozzle assembly is advanced into the opening there comes a point at which the sidewalls of the opening prevent the nozzle carrier from moving sideways.

Figure 5:
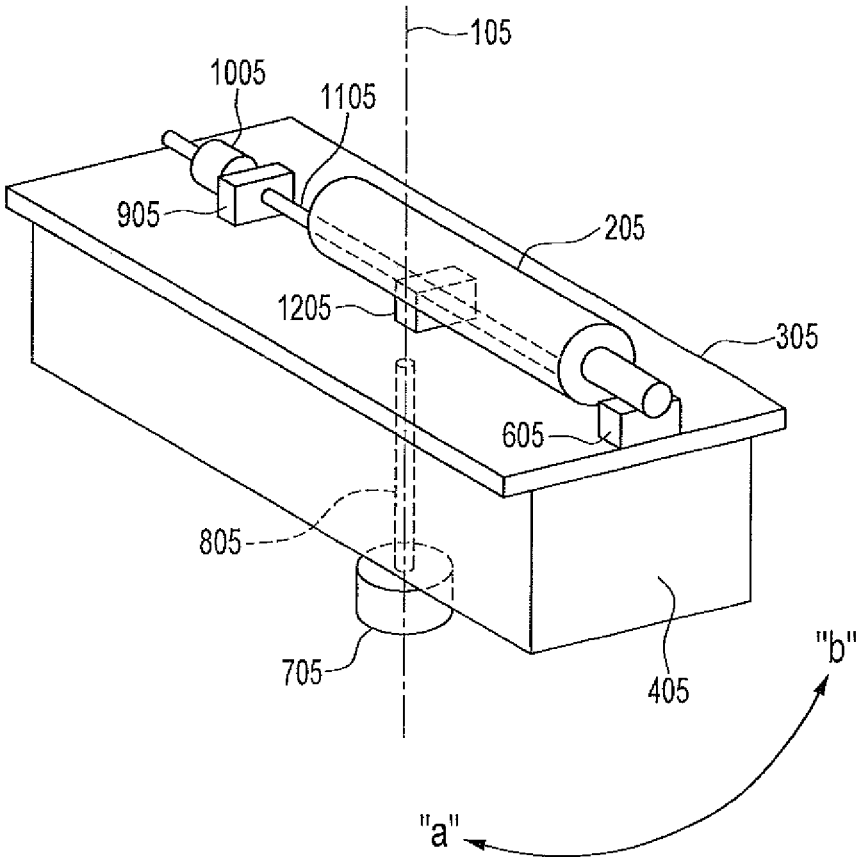
FIG. 5 is a perspective view of a nozzle carrier and means for yawing the nozzle carrier about the vertical axis.

FIG. 5 demonstrates this difficulty and shows a preferred embodiment of a nozzle carrier that overcomes it. Shown in FIG. 5 is a yawing nozzle carrier comprising a nozzle 205 mounted on a carrier block 405 by means of a plate 305, as previously described. Also shown is a rotating actuator 1005, a threaded lead screw 1105, and threaded drive blocks 605 and 905 that receive the threaded lead screw. The lead screw passes through threaded drive plate 1205, which is connected to the body of nozzle 205. As actuator 1005 rotates, the nozzle is carried forward or backward along its longitudinal axis.

The nozzle carrier has a vertical axis of rotation 105 about which the carrier yaws so that the jet stream prescribes an arc shown as "a"-"b". This yawing is effectuated by a rotating actuator, such as a stepper motor 705 that has a shaft 805 coincident with the vertical axis of rotation and immovably fixed in the nozzle block 405. As the shaft is made to turn by the stepper motor, the nozzle yaws about the vertical axis of rotation. Consequently, as the nozzle carrier moves toward a side of the opening, the carrier yaws towards that side, thereby directing the jet stream against the side and cutting away the side before the carrier-bar's movement is interfered with. By cutting the sides of the workface in this manner, the sides of the opening are cleanly and evenly cut away and the nozzle carrier-bar can be extended into deep openings.

Rotating Nozzle

Figure 6:
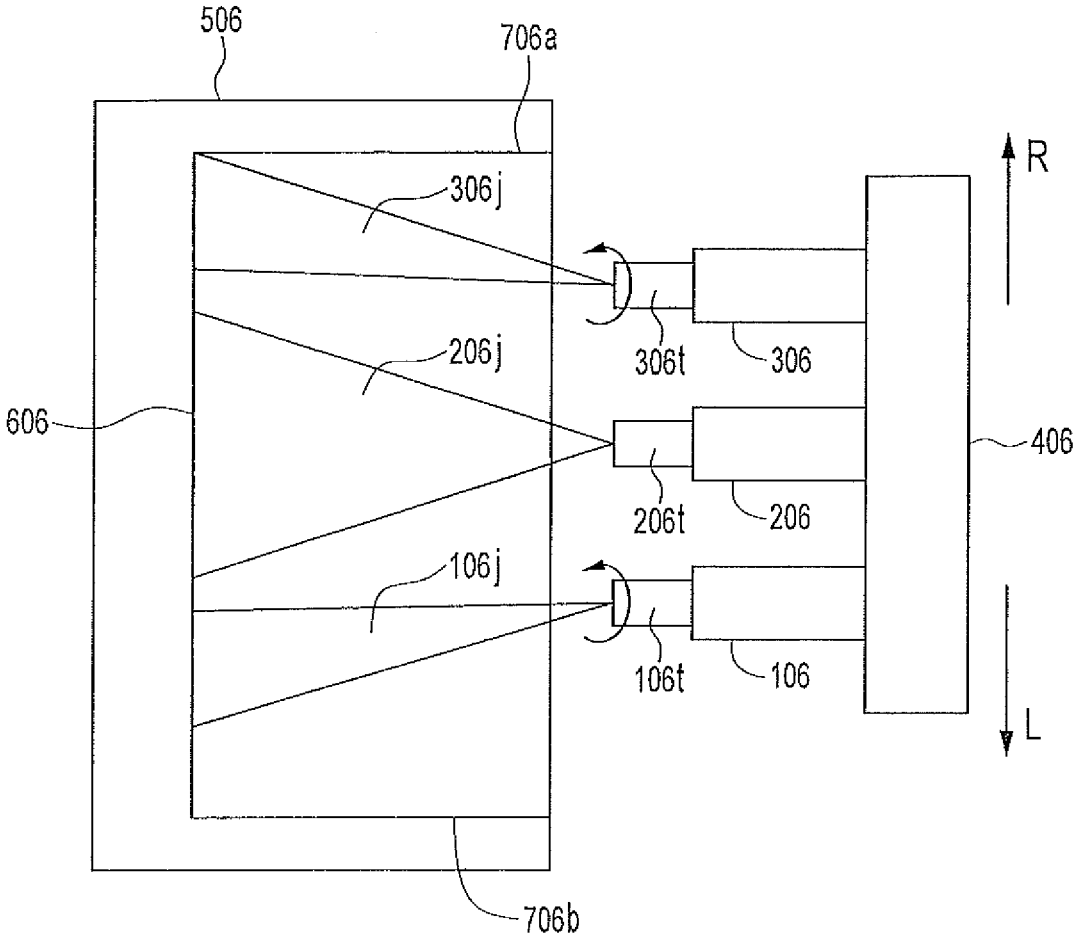
FIG. 6 is a top elevation of a nozzle carrier moving nozzles back and forth across a workface.

Additionally, or alternatively, depending on the application, it may be useful to direct the jet stream at an angle to the nozzle's longitudinal axis and then rotate the nozzle, thereby causing an annular jet stream to be emitted that extends beyond the edge of the nozzle carrier. FIG. 6 shows a top elevation of a wall 506 being breached by the invention wherein the workface 606 is moving deeper into the wall as the hydrodemolition process proceeds. Nozzles 106, 206, and 306 form a nozzle assembly, which is carried back and forth from right ("R") to left ("L") along the workface by nozzle carrier 406, as indicated by the arrows. The figure shows the nozzle carrier at its right-most extreme position, adjacent the right sidewall 706 of the opening.

The nozzles have nozzle tips, 106*t*, 206*t*, and 306*t*, which emit jet streams 106*j*, 206*j*, and 306*j*, respectively. The longitudinal axis of tip 206*t* coincides with the longitudinal axis of nozzle 206. Jet stream 206*j* is therefore substantially symmetrical about the longitudinal axis. Nozzle tips 106*t* and 306*t* have axes that are angled with respect to their nozzle longitudinal axes. This produces jet streams that are off-set from the longitudinal axis, and these jet streams inscribe annuli when the nozzles are rotated about the longitudinal axes. The desirable consequence of these annular jet streams 106*j*, 306*j* is that they are wider than the straight jet stream 206*j*. Consequently, the wider jet streams reach beyond the edge of the nozzle carrier 406 thereby making the opening wide enough to accommodate the nozzle carrier.

Curved Carrier-Bar

FIGS. 7-9 show an embodiment of the invention in which the carriage comprises a curved carrier-bar. In FIG. 7 is shown the curved carrier-bar 307 with end pieces 207*a*, 207*b* by which the bar is attached to the lift mechanism of the carriage. The curvature of the carrier-bar is substantially equal to the curvature of the wall to be deconstructed.

The carriage connector mechanism may be the same as described above; i.e. the carriage is mounted on the vertical members 108, 208 such that a lift-mechanism 308 moves the carriage up and down along the vertical members. The nozzle assembly 408 is connected to the curved carrier-bar in a manner that allows the nozzle assembly to be moved back and forth along the carrier bar by a drive-mechanism.

The advantage of the curved carrier-bar is demonstrated in FIG. 9. A curved wall 109, such as the wall of a nuclear reactor, is being breached with the by high-pressure erosive material delivered to the nozzles of nozzle-assembly 408. The nozzle assembly is shown in three consecutive positions as it moves from one vertical member 309 to the second vertical member 409 and back again. Because the curvature of carrier-bar 509 is substantially the same as the curvature of the wall 109, the longitudinal axis through the nozzle remains substantially perpendicular to the workface 209 throughout the movement back and forth. Consequently, the workface remains at a constant depth across its breadth throughout the deconstruction process without the operator having to continually extended and retract the nozzles. By contrast, when a straight carrier-bar is used with the center as close to the face of the wall as possible, the ends of the bar are farther from the face of the wall than the center due to the curvature of the wall, and in order to maintain a consistent depth while cutting into the wall, it is necessary to continually extend and retract the nozzles.

The curved carrier-bar may be permanently welded or other wise attached to the connector mechanisms, as shown in FIG. 7, wherein end-pieces 207*a*, 207*b* mate with the lift-mechanism. Alternatively, the bar may exist as unit reversibly detachable from the connector mechanism, as shown in FIG. 8 were the carrier-bar 508 is reversibly attachable to end-blocks 608*a*, 608*b*. The curved carrier-bar can then be easily replaced with a straight one, or with one having a different curvature, as required.

SUMMARY

As will be appreciated from the preceding disclosure, the hydrodemolition machine disclosed enjoys many and diverse applications. The hydrodemolition machine and its method of use are capable of producing openings with well delimited and square sides, even when deconstructing thick walls. It can be used to completely breach walls or to scarify just the surface of walls.

By incorporating the elevator work platform, it is not necessary to move the hydrodemolition machine out of the way in order for workers to gain access to exposed rebar. The workers simply mount the work platform and are lifted to the workface. Thus, the invention dispenses with a need to engage separate lifting equipment for lifting the workers.

The invention disclosed herein may be summarized with reference to the following numbered paragraphs

Paragraph 1

A machine for deconstructing a wall, said machine comprising:

a. a static support-frame;

b. a carriage mounted on said static support-frame, wherein said carriage comprises;

i. a carrier-bar;

ii. a first connector mechanism, wherein said first connector mechanism connects said carriage to said support-frame;

c. a first lift-mechanism, wherein said first lift-mechanism raises and lowers said carriage on said support frame;

d. at least one nozzle assembly mounted on said carrier-bar, said nozzle assembly comprising i. at least one nozzle;

ii. a second connector mechanism, wherein said second connector mechanism connects said nozzle to said carrier-bar; and, e. a drive-mechanism, wherein said drive-mechanism moves said nozzle assembly back and forth along said carrier-bar.

Paragraph 2

The hydrodemolition machine described in Paragraph 1 further comprising an adjuster, wherein said adjuster extends and retracts said nozzle toward and away from the workface.

Paragraph 3

The hydrodemolition machine described in Paragraph 2 wherein said adjuster comprises a mechanism chosen from the group consisting of: a rack and pinion mechanism; a chain and sprocket mechanism; a lead screw mechanism; and, a belt and pulley mechanism.

Paragraph 4

The hydrodemolition machine described in Paragraph 1 further comprising a yawing mechanism, wherein said yawing mechanism rotates said nozzle about a vertical axis.

Paragraph 5

The hydrodemolition machine described in Paragraph 1 wherein said connector mechanism comprises:

a. a first end block, wherein said first end block receives a first end of said carrier-bar; and, b. a second end block, wherein said second end block receives a second end of said carrier-bar.

Paragraph 6

The hydrodemolition machine described in Paragraph 5 wherein said first lift-mechanism raises and lowers said first end block and said second end block on said static support-frame.

Paragraph 7

The hydrodemolition machine described in Paragraph 1 further comprising:

a. a work platform movably mounted on said static support-frame; and, b. a work platform lift-mechanism for raising and lowering said work platform on said support-frame up and down the workface.

Paragraph 8

The hydrodemolition machine described in Paragraph 7 wherein said first lift-mechanism and said work platform lift-mechanism are the same.

Paragraph 9

The hydrodemolition machine described in Paragraph 7 wherein said work platform is mounted on said static support-frame by being mounted to said carrier-bar.

Paragraph 10

The hydrodemolition machine described in Paragraph 7 wherein said work platform lift-mechanism comprises a mechanism chosen from the group consisting of: a rack and pinion mechanism, a chain and sprocket mechanism, a lead screw mechanism, and a belt and pulley mechanism.

Paragraph 11

The hydrodemolition machine described in Paragraph 1 wherein said lift-mechanism comprises a mechanism chosen from the group consisting of: a rack and pinion mechanism, a chain and sprocket mechanism, a lead screw mechanism, and a belt and pulley mechanism.

Paragraph 12

The hydrodemolition machine described in Paragraph 1 further comprising an anchor platform, wherein said anchor platform supports said static support-frame.

Paragraph 13

The hydrodemolition machine described in Paragraph 12 further comprising means for reversibly connecting said static support-frame to said anchor platform.

Paragraph 14

A method of deconstructing a wall, the method comprising the steps of:

Step (a) placing the hydrodemolition machine described in Paragraph 1 adjacent the wall with the support-frame oriented to access a workface of the wall;

Step (b) connecting a supply of high-pressure erosive material to the nozzle;

Step (c) forming a jet stream of the erosive material of Step (b) by causing the erosive material to pass through the nozzle;

Step (d) aligning the nozzle so that jet stream of Step (c) erodes the surface of the workface;

Step (e) producing a swath of eroded surface on the workface by moving the nozzle aligned at Step (d) along the carrier-bar from one side of the workface to an opposing side of the workface;

Step (f) moving the carrier-bar to a higher position or lower position on the workface; and, Step (g) repeating Steps (c) through (f) for a sufficient number of iterations to remove a desired amount of the constituent material from the workface.

Paragraph 15

The method described in Paragraph 14, comprising the further step of:

Step (h) connecting a work platform to the support-frame, wherein the work platform is adapted to be raised and lowered on the support-frame.

Paragraph 16

The method described in Paragraph 15, comprising the further steps of:

Step (j) lifting rebar cutting equipment to the workface by means of the work platform of Step (h); and Step (k) removing exposed rebar within the workface with the rebar cutting equipment of Step (j).

Paragraph 17

The method described in Paragraph 14 wherein Step (a) includes the steps of:

Step (a1) placing an anchor platform adjacent the wall; and,

Step (a2) placing the static support-frame on the anchor platform.

Paragraph 18

The method described in paragraph 14 wherein the erosive material is water.

Paragraph 19

An apparatus for removing concrete from a wall of concrete, comprising:

a. a frame having a front region adjacent to the wall and supported by a platform;

b. a carriage coupled to said frame proximate said front region of said frame, said carriage comprising a carrier-bar that extends across said frame;

c. a nozzle carrier mounted on said carrier-bar and operative to move back and forth along said carrier-bar, wherein said nozzle carrier carries at least one nozzle that is operative to emit a jet stream of erosive material against the wall, wherein the jet stream has sufficient velocity to remove concrete from the wall;

d. a drive-mechanism coupled to said nozzle carrier and operative to drive said nozzle carrier back and forth along said carrier-bar;

e. a nozzle adjuster coupled between said nozzle and said nozzle assembly, wherein said nozzle adjuster is operative to adjust the position of said nozzle toward and away from the wall; and, f. a lift mechanism coupled to said carriage and operative to raise and lower said carriage along the front region.

Paragraph 20

A curved carrier-bar of a hydrodemolition machine, wherein said curved carrier-bar supports a nozzle as the nozzle moves back and forth along the face of a curved wall when the hydrodemolition machine is positioned adjacent the curved wall.

Paragraph 21

The curved carrier-bar described in Paragraph 20, wherein the curvature of said curved carrier bar is substantially equivalent to the curvature of the curved wall.

Paragraph 22

The curved carrier-bar described in Paragraph 20, wherein said curved carrier-bar is reversibly detachable from a carriage of the hydrodemolition machine.

Paragraph 23

A hydrodemolition machine carriage comprising said curved carrier-bar described in Paragraph 20.

From the foregoing description, the novelty, utility, and means of using our invention will be readily apprehended. It is to be understood that our invention is not limited to the embodiments disclosed above but encompasses any and all embodiments lying within the scope of the following claims. The metes and bounds of our invention are to be ascertained by referring to the claims in conjunction with the figures and the foregoing disclosures.

We claim:

1. A hydrodemolition machine for deconstructing a portion of a curved vertical wall of a building when the hydrodemolition machine is placed adjacent the wall, the hydrodemolition machine comprising:

a static support frame assembly for placement adjacent the wall, the static support frame assembly having at least two opposed vertical members;

a curved carrier-bar, opposed ends of said carrier-bar being movably connected to respective ones of said two vertical members so that said curved carrier-bar extends between said two vertical members so as to span substantially across the frame assembly, the curved carrier-bar being operative to move vertically along and between said two vertical members; and a nozzle assembly movably mounted on the curved carrier-bar and being operative to move along the curved carrier-bar between said vertical members, the nozzle assembly being operative to emit a jet of fluid against the wall of sufficient velocity to remove concrete from the wall.

2. The device of claim 1 wherein the curvature of the curved carrier-bar corresponds to the curvature of the wall such that the nozzle assembly remains at a constant distance from the wall as it is moved along the curved carrier-bar.

3. The device of claim 2 wherein the curved carrier-bar is reversibly detachable from the vertical members of the hydro-demolition machine.

* * * * *